US009777679B2

(12) United States Patent
Shimokawa

(10) Patent No.: US 9,777,679 B2
(45) Date of Patent: Oct. 3, 2017

(54) CANISTER

(71) Applicant: TOYOTA JIDOSHA KABUSHIKI KAISHA, Toyota-shi, Aichi-ken (JP)

(72) Inventor: Shinji Shimokawa, Seto (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 41 days.

(21) Appl. No.: 14/805,149

(22) Filed: Jul. 21, 2015

(65) Prior Publication Data

US 2016/0031318 A1 Feb. 4, 2016

(30) Foreign Application Priority Data

Jul. 29, 2014 (JP) ..... 2014-153989

(51) Int. Cl.
*F02M 25/08* (2006.01)

(52) U.S. Cl.
CPC ..... *F02M 25/0854* (2013.01)

(58) Field of Classification Search
CPC ..... F02M 25/0854; F02M 25/0836; F02M 25/0818; F02M 25/0872
USPC ..... 123/434
See application file for complete search history.

(56) References Cited

U.S. PATENT DOCUMENTS 4,700,683 A * 10/1987 Uranishi ..... F02M 25/0836 123/519
7,341,048 B2 * 3/2008 Koyama ..... F02D 41/0042 123/518
7,395,816 B2 * 7/2008 Loevenbruck ..... F02M 25/0872 123/519
9,359,977 B2 * 6/2016 Brock ..... F02M 25/0854
9,518,538 B2 * 12/2016 Pearce ..... F02M 25/0818 123/516
2004/0173190 A1 * 9/2004 Makino ..... F02D 41/004 123/520
2008/0141983 A1 * 6/2008 Takakura ..... F02M 25/089 123/520
2009/0031996 A1 * 2/2009 Chung ..... F02M 31/20 123/518

FOREIGN PATENT DOCUMENTS

JP H04-121451 A 4/1992
JP H09203353 A 8/1997
JP 2002-213308 A 7/2002
JP 2003-247462 A 9/2003

* cited by examiner

*Primary Examiner* — Carlos A Rivera
*Assistant Examiner* — Anthony Taylor, Jr.
(74) *Attorney, Agent, or Firm* — Oliff PLC

(57) ABSTRACT

A bypass flow channel that bypasses part of an adsorbent is provided between an engine-side port and an atmosphere-side port in a gas flow channel of a canister body. Furthermore, a flow rate increasing member that increases the ratio of flow rate in the bypass flow channel when the flow velocity of a gas at the time of purge has exceeded a predetermined value is provided.

6 Claims, 9 Drawing Sheets

CANISTER

INCORPORATION BY REFERENCE

The disclosure of Japanese Patent Application No. 2014-153989 filed on Jul. 29, 2014 including the specification, drawings and abstract is incorporated herein by reference in its entirety.

BACKGROUND OF THE INVENTION

1. Field of the Invention

The invention relates to a canister.

2. Description of Related Art

A canister for a vehicle has a structure that is provided with a bypass passage that opens to the atmosphere from an upstream adsorbent layer while bypassing a ventilation resistance portion and a downstream adsorbent layer. With this canister, the bypass passage is provided with a refueling opening valve that opens when the pressure in the bypass passage reaches a predetermined positive pressure (e.g., see Japanese Patent Application Publication No. 9-203353 (JP 9-203353 A)).

SUMMARY OF THE INVENTION

In the case where purge is carried out by applying a negative pressure from an engine to the interior of the canister, if the pressure loss of the canister is large, a high negative pressure may be applied to a fuel tank. If the pressure loss of the canister is reduced in consideration of the durability and the like of the fuel tank, it is difficult to increase the capacity of the canister.

The invention provides a canister that can make the pressure loss thereof small at the time of purge.

A first aspect of the invention is a canister that includes a canister body, an adsorbent, a tank-side port, an engine-side port, an atmosphere-side port, a bypass flow channel, and a flow rate increasing member. The adsorbent is accommodated inside the canister body. The adsorbent is configured to adsorb and desorb fuel vapors. The tank-side port is configured to hold the canister body in communication with a fuel tank. The engine-side port is configured to hold the canister body in communication with an engine. The atmosphere-side port is configured to hold the canister body in communication with atmosphere. The bypass flow channel is configured to bypass part of the adsorbent between the engine-side port and the atmosphere-side port in a gas flow channel of the canister body. The flow rate increasing member is configured to increase a ratio of flow rate in the bypass flow channel when a flow velocity of a gas flowing from the engine-side port to the engine has exceeded a predetermined value.

With this canister, a negative pressure from the engine is applied to the interior of the canister from the engine-side port, so the atmosphere is introduced from the atmosphere-side port. Then, fuel vapors adsorbed by the adsorbent in the canister are desorbed, and move to the engine.

In the gas flow channel of the canister body, part of the adsorbent can be bypassed between the engine-port and the atmosphere-side port by the bypass flow channel. It should be noted herein that the flow rate increasing member increases the ratio of flow rate in the bypass flow channel when the flow velocity of the gas flowing from the engine-side port to the engine has exceeded the predetermined value. "The ratio of flow rate" mentioned herein is the ratio of the amount of the gas flowing through the bypass flow channel to the total amount of the gas introduced from the atmosphere-side port due to the negative pressure in the engine. Accordingly, "the increase" includes an increase in the flow rate of the gas flowing through the bypass flow channel from zero.

That is, when the flow velocity in the canister at the time of purge increases due to an increase in the negative pressure from the engine, a larger amount of the gas flows through the bypass flow channel, so the ratio of the flow of the gas passing through the interior of the canister decreases. Thus, the pressure loss in the canister at the time of purge decreases.

A plurality of pieces of the adsorbent may be arranged between the engine-side port and the atmosphere-side port inside the canister body. The bypass flow channel may be connected to positions among the plurality of the pieces of the adsorbent, and the engine-side port or the atmosphere-side port.

The plurality of the pieces of the adsorbent are arranged between the engine-side port and the atmosphere-side port. Therefore, a structure for reliably bypassing one or some of the plurality of the pieces of the adsorbent by the bypass flow channel can be realized.

In the aforementioned canister, the bypass flow channel may include a plurality of branch portions that branch off at a plurality of positions among the plurality of the pieces of the adsorbent. Pieces of the flow rate increasing member that increase the ratio of flow rate at values of the flow velocity that are different from one another, may be arranged at the plurality of the branch portions respectively.

Thus, the purge amounts and the like of the pieces of the adsorbent can be individually adjusted for the plurality of the pieces of the adsorbent respectively. For example, the negative pressure applied to the canister from the engine, and the purge amounts of the pieces of the adsorbent (which one or ones of the pieces of the adsorbent should be purged and to what extent) can be adjusted.

In the aforementioned canister, the flow rate increasing member may be an on-off valve that is provided in the bypass flow channel.

By opening/closing the on-off valve, a changeover can be reliably made between a state where the ratio of flow rate of the gas in the bypass flow channel is large and a state where the ratio of flow rate of the gas in the bypass flow channel is small.

In the aforementioned canister, the on-off valve may open/close in accordance with a difference between a pressure on the engine side and a pressure on the atmosphere side.

The on-off valve opens/closes in accordance with the difference between the pressure on the engine side and the pressure on the atmosphere side. Therefore, a simple structure capable of opening/closing the bypass flow channel can be realized.

In the aforementioned canister, the flow rate increasing member may be configured by locally reducing an opening cross-section of the bypass flow channel.

A structure for increasing the ratio of flow rate in the bypass flow channel can be realized as a simple structure that is provided with an orifice.

In the aforementioned canister, the bypass flow channel may be arranged outside the canister body.

The bypass flow channel is arranged outside the canister body. Therefore, a larger number of pieces of the adsorbent can be accommodated inside the canister than in a structure in which the bypass flow channel is arranged inside the canister body.

Owing to the adoption of the aforementioned configuration, the pressure loss of the canister at the time of purge can be reduced.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

A canister 12 according to the first embodiment of the invention will be described with reference to the drawings.

Figure 1:
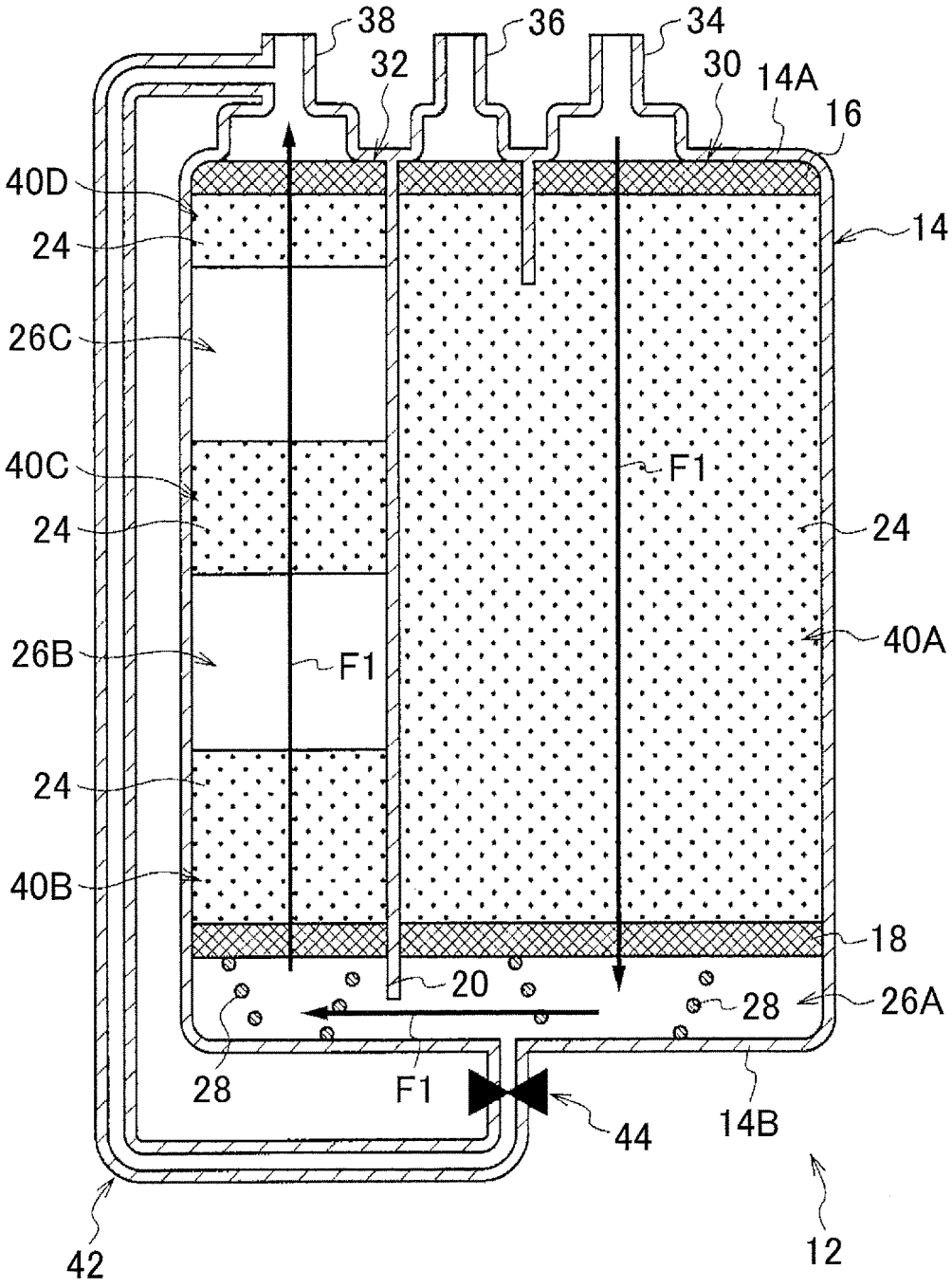
FIG. 1 is a cross-sectional view showing a canister according to the first embodiment of the invention.
Figure 2:
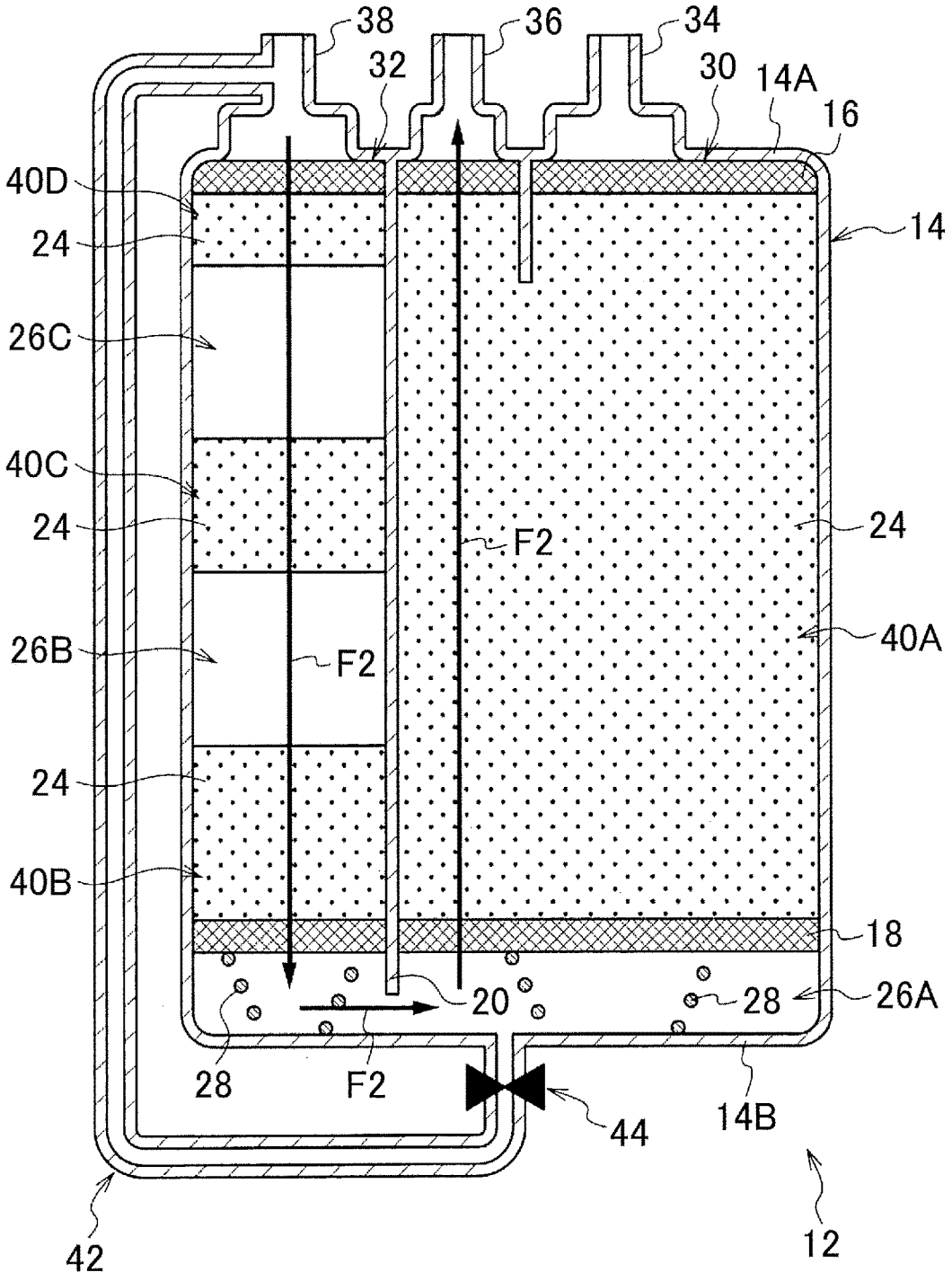
FIG. 2 is another cross-sectional view showing the canister according to the first embodiment of the invention.
Figure 3:
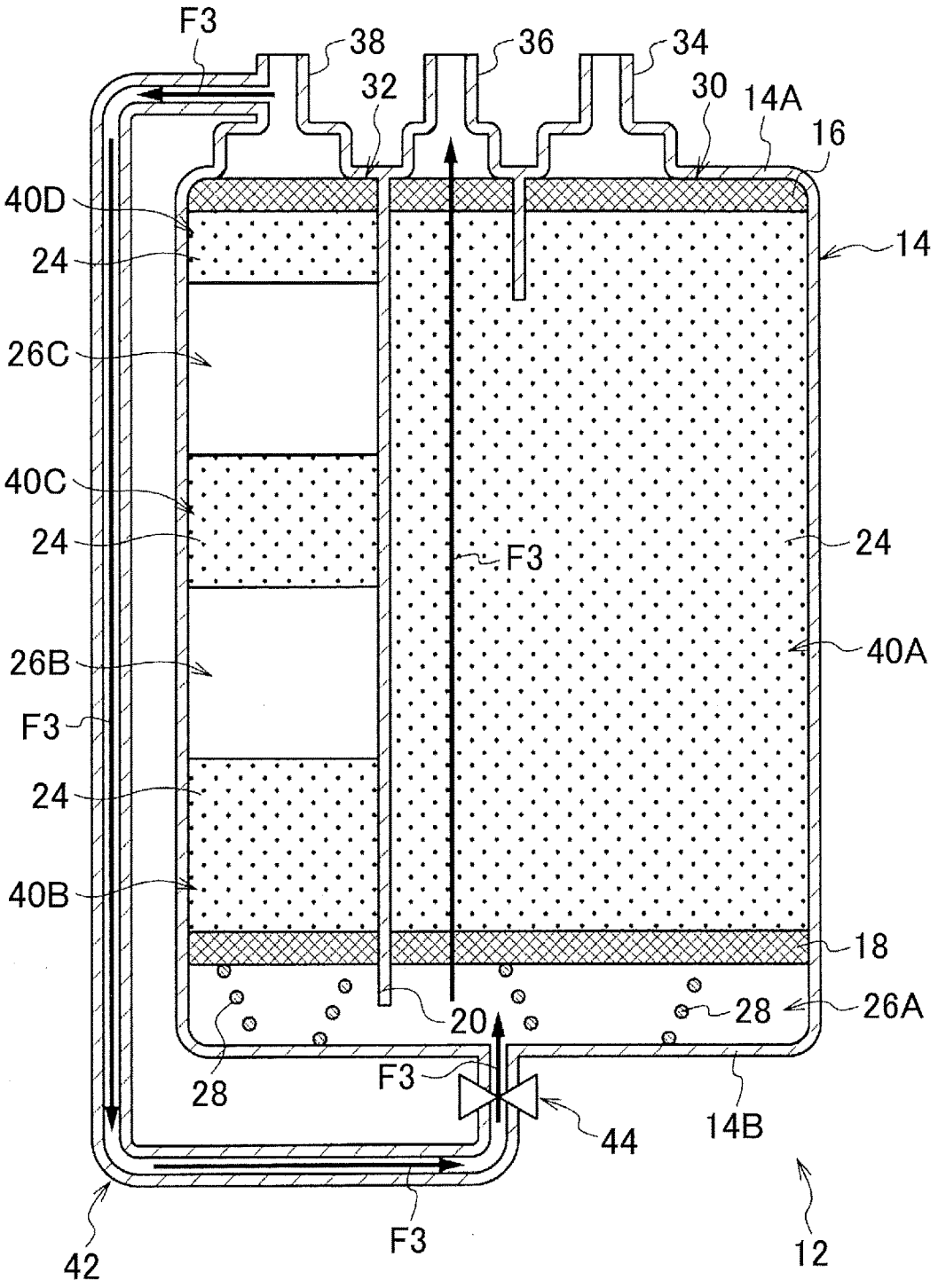
FIG. 3 is still another cross-sectional view showing the canister according to the first embodiment of the invention.

As shown in FIGS. 1 to 3, the canister 12 according to the first embodiment of the invention has a canister body 14 that is formed substantially in the shape of a box. Filter membranes 16 and 18, which are configured substantially in the shape of a plate from a non-woven fabric or the like, are provided parallel to a first end wall 14A and a second end wall 14B respectively, inside the canister body 14. Adsorbents 24 that are made of activated carbon or the like are accommodated between the filter membranes 16 and 18.

A first gap 26A is created between the filter membrane 18 and the second end wall 14B. As will be described later, this first gap 26A is a space in which a gas moves in the canister body 14.

A spring 28 is accommodated in the first gap 26A. The spring 28 presses the filter membrane 18 toward the interior of the canister body 14.

A partition wall 20 that reaches the filter membrane 18 is extended from the first end wall 14A of the canister body 14. This partition wall 20 and the filter membranes 16 and 18 partition the interior of the canister body 14 into two accommodation chambers 30 and 32.

A tank-side port 34 and an engine-side port 36 are provided through the first end wall 14A, at a position corresponding to the accommodation chamber 30. A vapor pipeline (not shown) is connected to the tank-side port 34. The vapor pipeline establishes communication between a fuel tank (not shown) and the canister body 14, and sends a gas containing fuel vapors in the fuel tank into the canister body 14.

A purge pipeline (not shown) is connected to the engine-side port 36. The purge pipeline establishes communication between an engine (not shown) and the canister body 14, and applies a negative pressure in the engine to the interior of the canister body 14.

Besides, an atmosphere-side port 38 is provided through the first end wall 14A at a position corresponding to the accommodation chamber 32. An atmosphere pipeline that holds the interior of the canister body 14 in communication with the atmosphere is connected to the atmosphere-side port 38.

For example, when fuel vapors are produced in the fuel tank, a gas containing the fuel vapors in the fuel tank flows into the canister body 14 as indicated by an arrow F1 in FIG. 1. Then, after the fuel vapors are adsorbed by the adsorbents, the gas is discharged from the atmosphere-side port 38 into the atmosphere via the atmosphere pipeline.

Besides, while the engine is driven, the negative pressure in the engine can be applied to the interior of the canister body 14 from the engine-side port 36. Thus, as indicated by an arrow F2 in FIG. 2, the atmosphere can be introduced from the atmosphere-side port 38, and the fuel vapors adsorbed by the adsorbents can be desorbed. The desorbed fuel vapors move from the engine-side port 36 to the engine to be burned in the engine.

In the first embodiment of the invention, a plurality of (three in the illustrated example) the adsorbents 24 are arranged along a flow direction of the gas (a direction indicated by the arrow F1 or the arrow F2) in the accommodation chamber 32. On the whole, the canister body 14 is partitioned into a first adsorption chamber 40A, a second adsorption chamber 40B, a third adsorption chamber 40C, and a fourth adsorption chamber 40D in the descending order of capacity from the tank-side port 34 (the engine-side port 36) toward the atmosphere-side port 38. The adsorbents 24 that are accommodated in the first adsorption chamber 40A, the second adsorption chamber 40B, the third adsorption chamber 40C and the fourth adsorption chamber 40D may be identical in type to one another, but may be different in type from one another.

It should be noted herein that the first gap 26A is located between the first adsorption chamber 40A and the second adsorption chamber 40B when viewed from the flow direction of the gas introduced into the canister body 14 from the fuel tank (see the arrow F1 in FIG. 1). Besides, a second gap 26B is located between the second adsorption chamber 40B and the third adsorption chamber 40C. A third gap 26C is located between the third adsorption chamber 40C and the fourth adsorption chamber 40D. Any one of the first to third gaps is located between the engine-side port 36 and the tank-side port 34 in the flow channel of the gas in the canister body 14.

In the first embodiment of the invention, a bypass flow channel 42 branches off from a position of the first gap 26A in the canister body 14. The other end of the bypass flow channel 42 is connected to the atmosphere-side port 38 (or the atmosphere pipeline (not shown)).

An on-off valve 44 is arranged in the bypass flow channel 42. The on-off valve 44 is usually closed, but is opened when the flow velocity of the gas flowing from the engine-side port 36 toward the engine side exceeds a predetermined value set in advance. For example, when the negative pressure from the engine is applied to the canister body 14, a differential pressure is generated at the position of the on-off valve 44 between the engine-side port 36 and the atmosphere-side port 38. More specifically, the negative pressure is applied to an upper side of the on-off valve 44 in FIG. 3, but an atmospheric pressure is applied to a lower side of the on-off valve 44. Then, when the flow velocity of the gas flowing from the engine-side port 36 toward the engine side increases, the differential pressure therebetween increases as well. For example, an on-off valve whose opening pressure is set such that this differential pressure opens the on-off valve can be employed as the on-off valve 44 of the present embodiment of the invention.

Next, the operation of the canister 12 according to the present embodiment of the invention will be described.

When the gas containing the fuel vapors produced in the fuel tank (not shown) flows from the vapor pipeline (not shown) into the canister body 14 via the tank-side port 34, this gas flows in the canister body 14 as indicated by the arrow F1 in FIG. 1. The fuel vapors in the gas are adsorbed by the adsorbents in the canister body 14. Then, after the fuel vapors are adsorbed by the adsorbents, the gas is discharged from the atmosphere pipeline (not shown) into the atmosphere via the atmosphere-side port 38.

While the engine (not shown) is driven, the negative pressure in the engine can be applied to the interior of the canister body 14 from the purge pipeline (not shown) via the engine-side port 36. Thus, as indicated by the arrow F2 in FIG. 2, the fuel vapors adsorbed by the adsorbents can be desorbed (purged) by taking in the atmosphere from the atmosphere pipeline. The desorbed fuel vapors move to the engine to be burned.

When purge is thus carried out, the gas flows from the engine-side port 36 toward the tank-side port 34 (as indicated by the arrow F2) in the canister body 14. The flow velocity of this gas (the purge flow velocity) changes in accordance with the drive state of the engine (the running state of the vehicle) or the like.

With the canister 12 according to the present embodiment of the invention, the on-off valve 44 that is provided in the bypass flow channel 42 is set in such a manner as to open when the flow velocity of the gas flowing from the tank-side port 34 to the engine-side port 36 exceeds a predetermined value set in advance.

Figure 4:
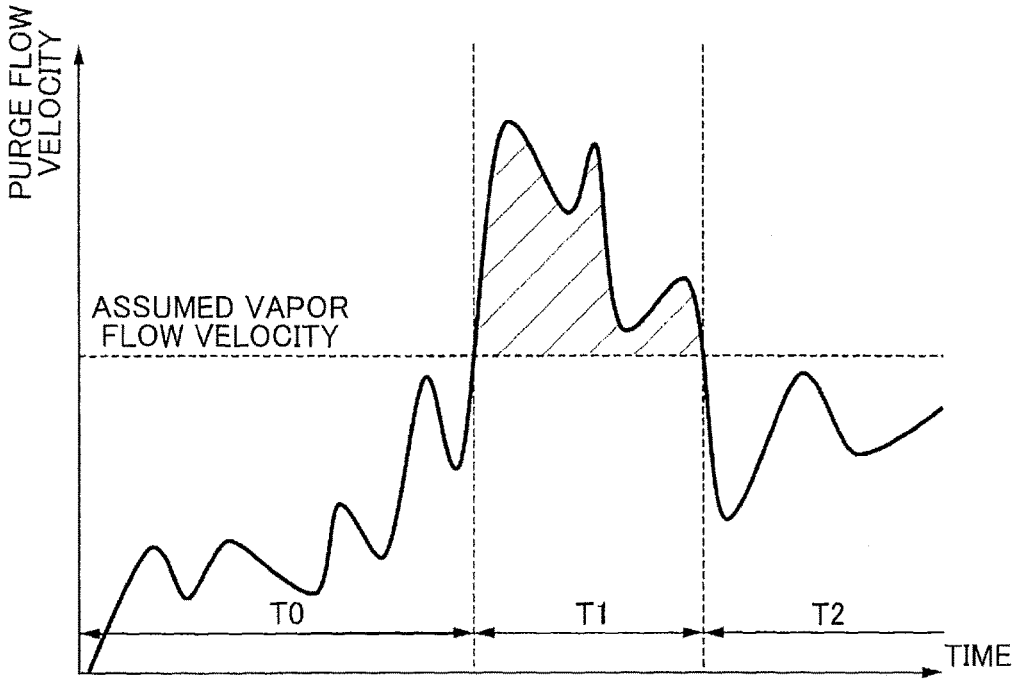
FIG. 4 is a graph qualitatively showing how the vapor flow velocity changes with time in the canister according to the first embodiment of the invention.

FIG. 4 qualitatively shows a relationship between the drive time of the engine and the purge flow velocity. It is apparent from this graph as well that the purge flow velocity changes with time in accordance with the drive state of the engine or the like.

The adsorbents 24 are accommodated in the canister body 14. Therefore, a pressure loss occurs when the gas moves through the adsorbents 24 in the canister body 14. More specifically, when a negative pressure from the engine is applied to the canister body 14, there is a pressure loss between the engine-side port 36 and the atmosphere-side port 38. That is, a great resistance takes place in introducing the atmosphere from the atmosphere-side port 38, and part of the negative pressure from the engine is applied to the fuel tank as well.

It should be noted herein that a canister with a structure devoid of the bypass flow channel 42 and the on-off valve 44 of the present embodiment of the invention is conceived as a comparative example. With the canister according to the comparative example, even when the flow velocity of the gas increases in the canister due to a negative pressure from the engine, the pressure loss of all the adsorbents in the canister body acts on the fuel tank. That is, a high negative pressure is applied to the fuel tank as well.

With the canister according to the comparative example, in the graph shown in FIG. 4, at a time T0, the purge flow velocity is lower than an assumed vapor speed, so the negative pressure applied to the fuel tank is low. However, at a time T1, the purge flow velocity is higher than the assumed vapor speed, so the negative pressure applied to the fuel tank is also high. In fact, the amount of the adsorbents needs to be limited such that this high negative pressure is not applied to the fuel tank, in other words, such that the pressure loss of the canister decreases. It is difficult to enhance the performance by increasing the capacity of the canister.

With the canister 12 according to the present embodiment of the invention, at the time T0 in the graph shown in FIG. 4, the purge flow velocity is lower than the assumed vapor flow velocity, so the on-off valve 44 remains closed. No gas flows in the bypass flow channel 42, so the adsorbents in the canister body 14 are not bypassed, and all the adsorbents can be purged. Then, the purge speed has not reached the assumed vapor flow velocity, so the negative pressure applied to the fuel tank is also low.

In contrast, at the time T1, the purge flow velocity is higher than the assumed vapor flow velocity. However, with the canister 12 according to the present embodiment of the invention, the on-off valve 44 is opened in this case, and the ratio of flow rate of the gas flowing through the bypass flow channel 42 increases (increases from zero to reach a certain value). Then, the gas flows while bypassing the adsorbents 24 in the second adsorption chamber 40B, the third adsorption chamber 40C, and the fourth adsorption chamber 40D in the canister body 14. Therefore, the pressure loss in the canister body 14 becomes small, and the negative pressure applied to the fuel tank also becomes low.

With the canister 12 according to the present embodiment of the invention, as described hitherto, the negative pressure applied to the fuel tank is low in a state where the purge flow velocity is higher than the assumed vapor flow velocity. Therefore, with the canister 12 according to the present embodiment of the invention, the amount of the adsorbents is made larger than in the case of the canister according to the comparative example. As a result, it is possible to enhance the performance by increasing the capacity of the canister.

Moreover, with the canister 12 according to the present embodiment of the invention as well, fuel vapors can be desorbed from the region that does not bypass the interior of the canister body 14, more specifically, the adsorbent 24 in the first adsorption chamber 40A that is located more on the fuel tank side than the on-off valve 44. In the present embodiment of the invention in particular, the adsorbent can be purged in the first adsorption chamber 40A that is located close to the fuel tank.

Incidentally, when the purge flow velocity is lower than the assumed vapor flow velocity (at a time T2 in the graph shown in FIG. 4), the on-off valve 44 is closed. Accordingly, due to a negative pressure from the engine, the gas flows through the fourth adsorption chamber 40D, the third adsorption chamber 40C, the second adsorption chamber 40B, and the first adsorption chamber 40A in this order in the canister body 14.

Next, the second embodiment of the invention will be described. In the second embodiment of the invention, the same elements, members and the like as in the first embodiment of the invention are denoted by the same reference symbols as in the first embodiment of the invention respectively, and will not be described below in detail.

Figure 5:
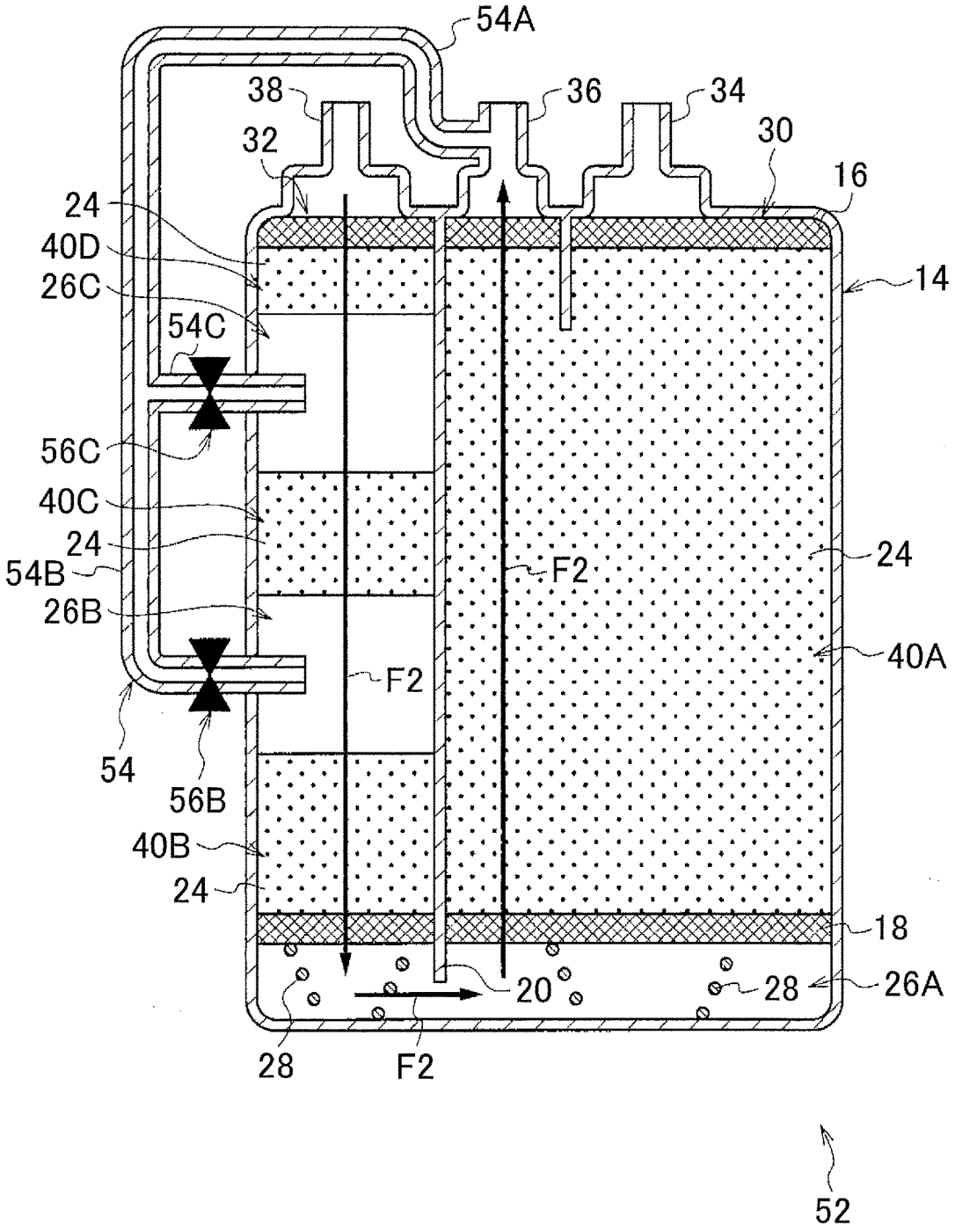
FIG. 5 is a cross-sectional view showing a canister according to the second embodiment of the invention.
Figure 6:
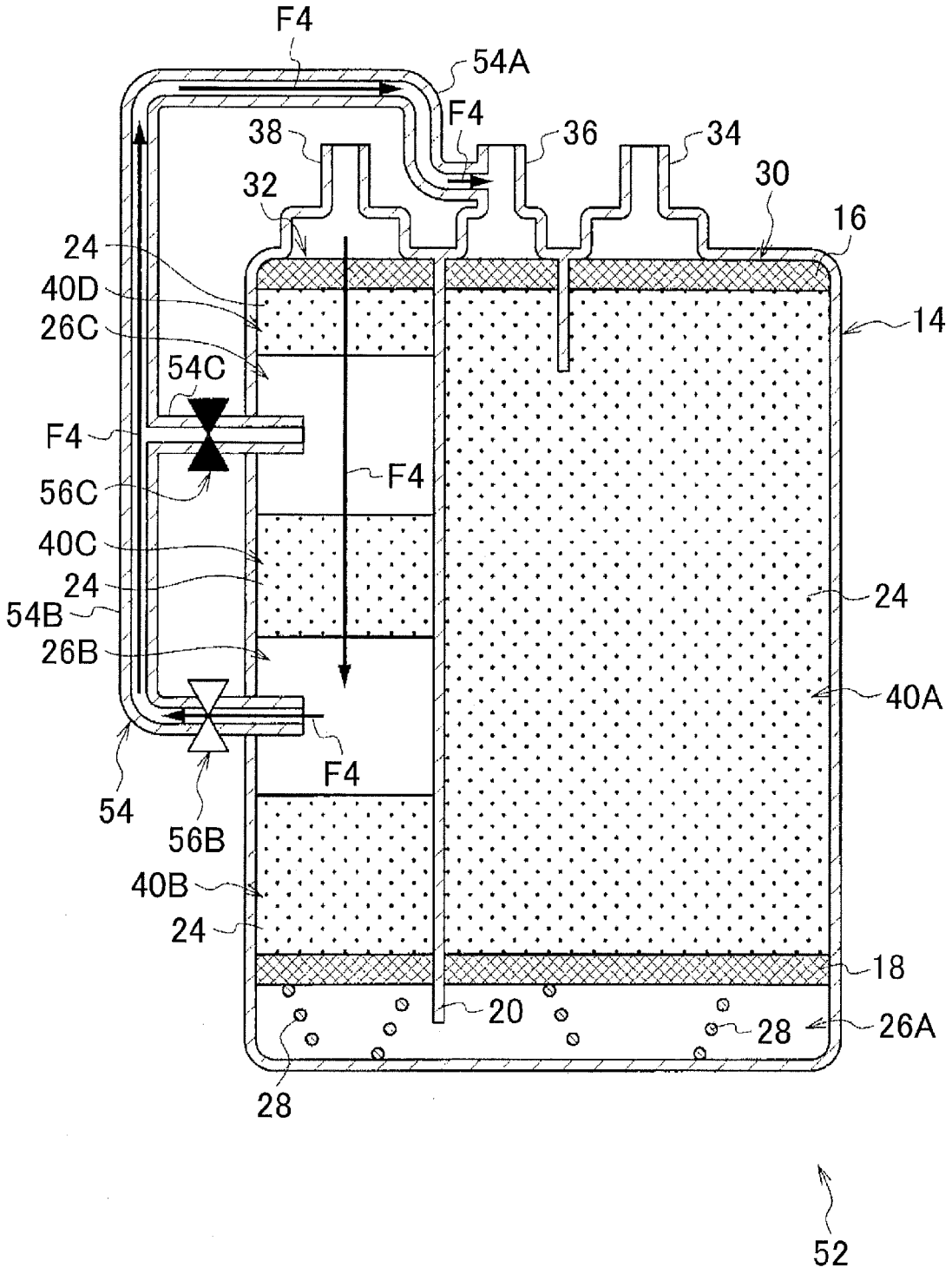
FIG. 6 is another cross-sectional view showing the canister according to the second embodiment of the invention.
Figure 7:
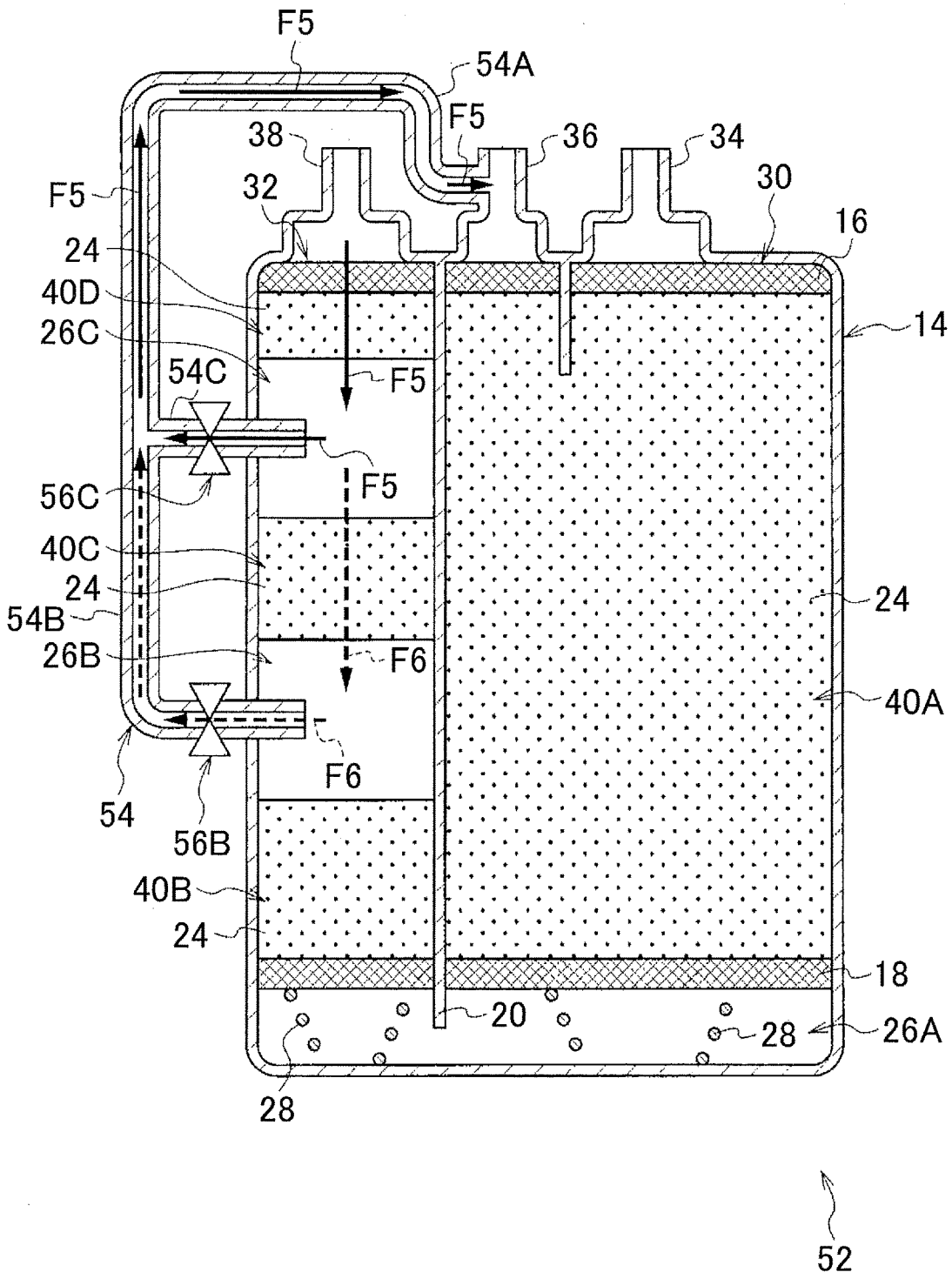
FIG. 7 is still another cross-sectional view showing the canister according to the second embodiment of the invention.

As shown in FIGS. 5 to 7, a canister 52 according to the second embodiment of the invention is provided with a bypass flow channel 54 instead of the bypass flow channel 42 (see FIGS. 1 to 3).

The bypass flow channel 54 has a confluence portion 54A that is connected to the engine-side port 36, and branch portions 54B and 54C that branch off from this confluence portion 54A and that are connected to the second gap 26B and the third gap 26C respectively.

On-off valves 56B and 56C are arranged at the branch portions 54B and 54C respectively. The opening pressures of the on-off valves 56B and 56C may be equal to each other. However, for example, the opening pressure (a first opening pressure) of the on-off valve 56B that is located far from the atmosphere-side port 38 is set lower than the opening pressure (a second opening pressure) of the on-off valve 56C that is located close to the atmosphere-side port 38.

With the canister 52 according to the second embodiment of the invention configured as described above, when the negative pressure applied from the engine has not reached the first opening pressure, the flow velocity of the gas in the canister body 14 is low. Therefore, as shown in FIG. 5, both the on-off valves 56B and 56C are closed. The gas flows in the canister body 14 without bypassing any one of the adsorbents 24, as indicated by the arrow F2.

When the negative pressure applied from the engine reaches the first opening pressure (when the flow velocity of the gas in the canister body 14A increases), the on-off valve 56B is opened as shown in FIG. 6, and the ratio of flow rate of the gas flowing through the bypass flow channel 54 increases (increases from zero to reach a certain value). Thus, as indicated by an arrow F4, the gas flows while bypassing the adsorbents 24 in the first adsorption chamber 40A and the second adsorption chamber 40B. Therefore, the pressure loss of the canister 52 is smaller than in the case where the gas flows through all the adsorption chambers. In this case, the gas flows through the third adsorption chamber 40C and the fourth adsorption chamber 40D, so fuel vapors can be desorbed from the adsorbents 24 in the third adsorption chamber 40C and the fourth adsorption chamber 40D.

Furthermore, when the negative pressure applied from the engine reaches the second opening pressure (when the flow velocity of the gas in the canister body 14A further increases), the on-off valve 56C as well as the on-off valve 56B is opened as shown in FIG. 7. Thus, as indicated by an arrow F5, the gas flows while bypassing the adsorbents 24 in the first adsorption chamber 40A, the second adsorption chamber 40B and the third adsorption chamber 40C. Therefore, the pressure loss of the canister 52 is smaller than in the case where the gas flows through all the adsorption chambers. In this case, the gas flows through the fourth adsorption chamber 40D, so fuel vapors can be desorbed from the adsorbent in the fourth adsorption chamber 40D. In the present embodiment of the invention in particular, the adsorbent can be purged in the fourth adsorption chamber 40D that is located close to the atmosphere side. Incidentally, if the flow resistance of the gas in the third adsorption chamber 40C assumes a certain value, a large amount of the gas flows mainly through the fourth adsorption chamber 40D. However, as indicated by an arrow F6, part of the gas may flow through the third adsorption chamber 40C. In this case, the adsorbent 24 in the third adsorption chamber 40C can also be purged.

As described hitherto, with the canister 52 according to the second embodiment of the invention, the adsorbent 24 in a specific one of the adsorption chambers can be purged by appropriately setting the opening pressures of the on-off valves 56B and 56C. For example, even with a structure having a larger number of adsorption chambers, purge can be carried out for a specific one of the adsorption chambers by appropriately setting the opening pressure of each of the on-off valves. The respective adsorption chambers have different pressure losses, but the amount of purge can also be controlled by adjusting the negative pressure applied from the engine and the adsorption chambers to be subjected to purge.

In the first embodiment of the invention and the second embodiment of the invention, the on-off valves 44, 56B, and 56C are not absolutely required to open/close in accordance with the difference in pressure as described above. For example, the engine-side port 36 or the like may be provided with a flow velocity sensor that detects a flow velocity of the gas at the time of purge, and an electromagnetic valve that electromagnetically opens/closes based on a detected value of the flow velocity may be provided. When the aforementioned on-off valves 44, 56B, and 56C are employed, no flow velocity sensor is required. A simple structure for opening/closing the bypass flow channel 42 or 54 can be realized. Besides, there is no need to provide the on-off valves with electromagnetic drive mechanisms. Therefore, it is possible to contribute toward reducing the number of parts and cutting down on costs.

Next, the third embodiment of the invention will be described. In the third embodiment of the invention as well, the same elements, members and the like as in the first embodiment of the invention or the second embodiment of the invention are denoted by the same reference symbols as in the first embodiment of the invention or the second embodiment of the invention respectively, and will not be described below in detail.

Figure 8:
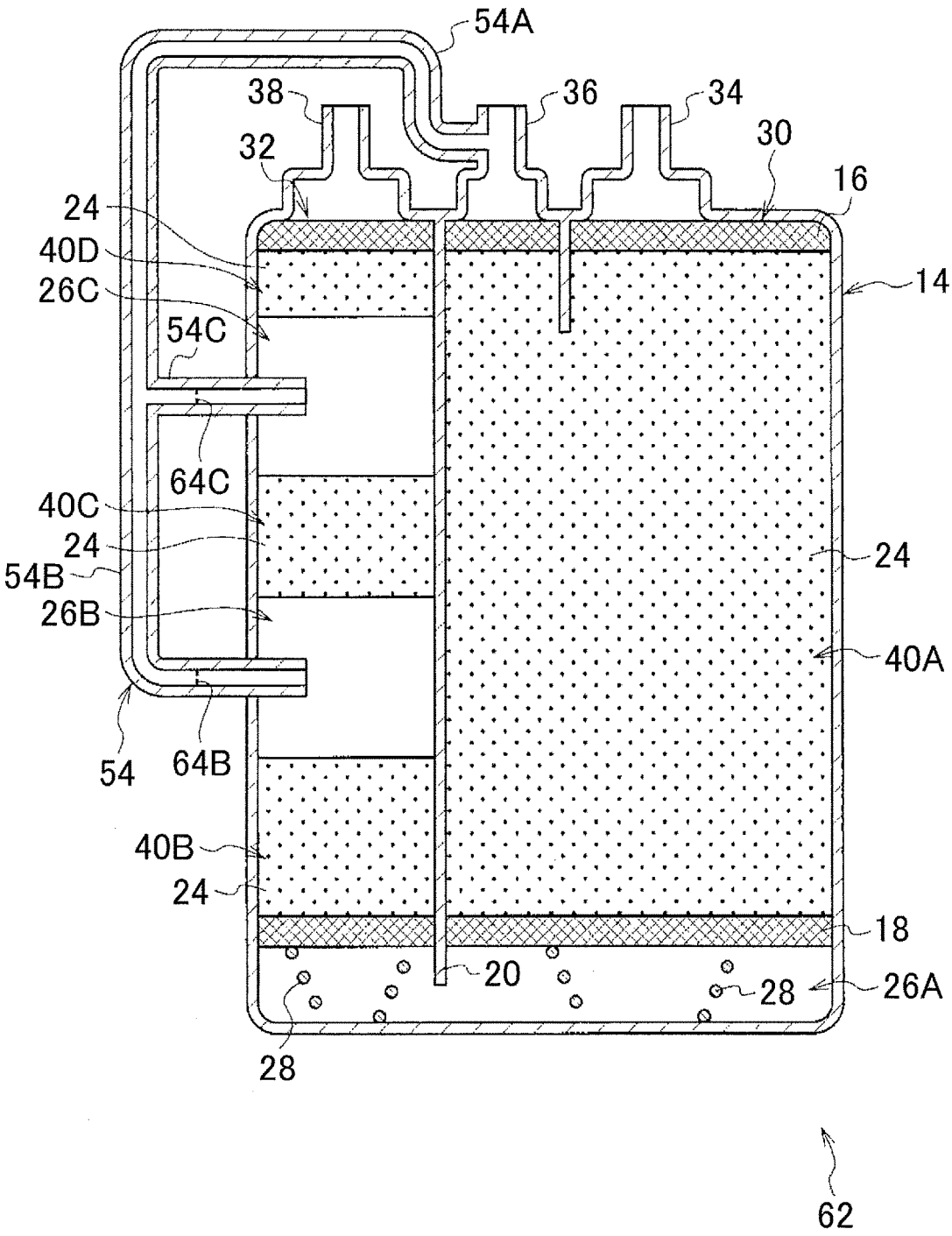
FIG. 8 is a cross-sectional view showing a canister according to the third embodiment of the invention.

As shown in FIG. 8, a canister 62 according to the third embodiment of the invention has the bypass flow channel 54 similar to that of the canister 52 according to the second embodiment of the invention. However, orifices 64B and 64C are arranged instead of the on-off valves 56B and 56C respectively. The orifices 64B and 64C are obtained by locally reducing the flow cross-section of the bypass flow channel 54.

With the canister 62 according to the third embodiment of the invention configured as described above, when the negative pressure applied from the engine is low, the orifices 64B and 64C serve as a resistance against the flow of the gas, so the ratio of flow rate of the gas flowing through the bypass flow channel 54 is small.

In contrast, when the negative pressure applied from the engine increases, the orifices 64B and 64C serve as a resistance against the flow of the gas, but the gas gradually flows through the bypass flow channel 54. That is, the ratio of flow rate of the gas flowing through the bypass flow channel 54 increases.

That is, with the canister 62 according to the third embodiment of the invention, when the negative pressure applied from the engine increases, the ratio of flow rate of the gas flowing while bypassing the adsorbents in the first adsorption chamber 40A and the second adsorption chamber 40B increases, and the pressure loss of the canister 62 decreases. Incidentally, the gas flows through the third adsorption chamber 40C and the fourth adsorption chamber 40D, so fuel vapors can be desorbed from the adsorbents in the third adsorption chamber 40C and the fourth adsorption chamber 40D.

The canister 62 according to the third embodiment of the invention employs the orifices 64B and 64C as flow rate increasing members. Therefore, the flow rate increasing members can be configured with a simple structure.

In contrast, the canister 12 according to the first embodiment of the invention and the canister 52 according to the second embodiment of the invention employ the on-off valves 44 and 56B respectively as the flow rate increasing members. A structure for bypassing one or some of the adsorbents 24 at a desired purge flow velocity can be realized by appropriately setting the opening pressures of the on-off valves 44 and 56C.

Next, the fourth embodiment of the invention will be described. In the fourth embodiment of the invention as well, the same elements, members and the like as in the first embodiment of the invention are denoted by the same reference symbols as in the first embodiment of the invention respectively, and will not be described below in detail.

Figure 9:
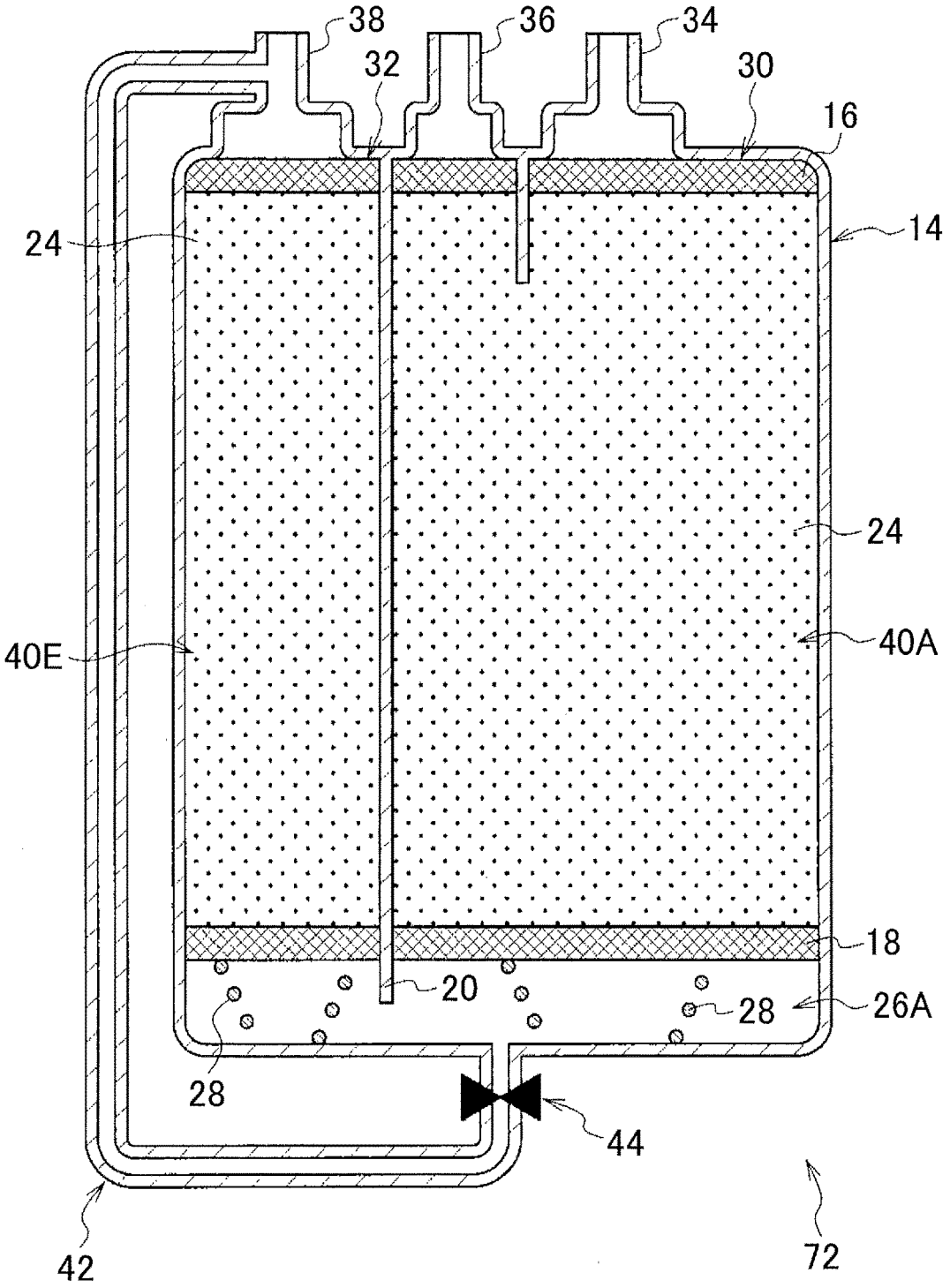
FIG. 9 is a cross-sectional view showing a canister according to the fourth embodiment of the invention.

With a canister 72 according to the fourth embodiment of the invention, as shown in FIG. 9, the interior of the accommodation chamber 32 is not partitioned into a plurality of chambers. Then, a second adsorption chamber 40E with a structure that is obtained by integrating the second adsorption chamber 40B, the third adsorption chamber 40C, and the fourth adsorption chamber 40D according to the first embodiment of the invention with one another is configured.

The canister 72 according to the fourth embodiment of the invention is identical in configuration to the canister 12 according to the first embodiment of the invention except in the foregoing.

With the canister 72 according to the fourth embodiment of the invention, when the purge flow velocity is higher than an assumed vapor flow velocity, the on-off valve 44 is opened. The gas flows through the bypass flow channel 42. The gas flows while bypassing one or some of the adsorbents in the canister body 14 (the second adsorption chamber 40E). Therefore, the pressure loss in the canister body 14 decreases, and the negative pressure applied to the fuel tank also decreases.

In the fourth embodiment of the invention, the interior of the accommodation chamber 32 is not partitioned into a plurality of chambers, so the structure can be simplified.

With the canister 12 according to the first embodiment of the invention and the canister 72 according to the fourth embodiment of the invention, even when the on-off valve 44 is opened, the gas flows through the first adsorption chamber 40A at the time of purge. That is, the adsorbent 24 in the first adsorption chamber 40A that is located closest to the fuel tank can be reliably purged.

In contrast, with the canister 52 according to the second embodiment of the invention and the canister 62 according to the third embodiment of the invention, the gas flows through the fourth adsorption chamber 40D at the time of purge. The fourth adsorption chamber 40D is the last region through which the gas containing the fuel vapors that have flowed from the fuel tank passes. The adsorbent 24 in the last region through which the gas thus passes can be reliably purged.

In each of the aforementioned embodiments of the invention, the bypass flow channel 42 or 54 is arranged outside the canister body 14. The interior of the canister body 14 can be more effectively utilized as an accommodation space for the adsorbents than in the structure in which a bypass flow channel is provided inside the canister body 14.

What is claimed is:

1. A canister comprising:

a canister body;

a tank-side port configured to communicate with a fuel tank;

an engine-side port configured to communicate with an engine;

an atmosphere-side port configured to communicate with an atmosphere outside the canister body;

an adsorbent accommodated inside the canister body, the adsorbent being configured to adsorb and desorb fuel vapors, a plurality of pieces of the adsorbent being arranged between the engine-side port and the atmosphere-side port inside the canister body;

a bypass flow channel configured to bypass part of the adsorbent between the engine-side port and the atmosphere-side port in a gas flow channel of the canister body, the bypass flow channel including at least two branch portions, each of the at least two branch portions extending from a position between different ones of the plurality of the pieces of the adsorbent; and a flow rate increasing valve or orifice arranged at each one of the at least two branch portions, each flow rate increasing valve or orifice is configured to increase a flow rate of a gas flowing in the bypass flow channel when a flow velocity of the gas flowing from the engine-side port to the engine has exceeded a predetermined value, and wherein the flow rate increasing valve or orifice arranged at each one of the at least two branch portions is configured such that values of the flow velocity of the gas through each respective branch portion are different from one another.

2. The canister according to claim 1, wherein:

the bypass flow channel is connected to positions among the plurality of the pieces of the adsorbent, and the engine-side port.

3. The canister according to claim 1, wherein the flow rate increasing valve or orifice is an on-off valve that is provided in the bypass flow channel.

4. The canister according to claim 3, wherein the on-off valve is configured to open/close in accordance with a difference in pressure between the engine-side port and the atmosphere-side port.

5. The canister according to claim 1, wherein the flow rate increasing valve or orifice is configured by locally reducing a cross-sectional area of a lumen of the bypass flow channel.

6. The canister according to claim 1, wherein the bypass flow channel is arranged outside the canister body.

* * * * *